US007091811B2

(12) United States Patent
Gudmundson

(10) Patent No.: US 7,091,811 B2
(45) Date of Patent: Aug. 15, 2006

(54) FIXING MEMBER

(75) Inventor: Sebastian Gudmundson, Sunnansjö (SE)

(73) Assignee: ABB AB, Västerås (SE)

( * ) Notice: Subject to any disclaimer, the term of this patent is extended or adjusted under 35 U.S.C. 154(b) by 151 days.

(21) Appl. No.: 10/481,035

(22) PCT Filed: May 31, 2002

(86) PCT No.: PCT/SE02/01049

§ 371 (c)(1),
(2), (4) Date: Dec. 17, 2003

(87) PCT Pub. No.: WO02/103724

PCT Pub. Date: Dec. 27, 2002

(65) Prior Publication Data

US 2004/0155746 A1 Aug. 12, 2004

(30) Foreign Application Priority Data

Jun. 18, 2001 (SE) ..... 0102143

(51) Int. Cl.
*H01F 27/28* (2006.01)

(52) U.S. Cl. ..... 336/195; 336/199

(58) Field of Classification Search ..... 336/195–197, 336/199, 206
See application file for complete search history.

(56) References Cited

U.S. PATENT DOCUMENTS 4,109,098 A * 8/1978 Olsson et al. ..... 174/106 SC
5,575,869 A * 11/1996 Fujiwara et al. ..... 156/64
5,587,526 A * 12/1996 Lumley et al. ..... 73/382 G

FOREIGN PATENT DOCUMENTS

DE 2753952 A1 10/1978
EP 309383 A1 * 3/1989 ..... 337/148
WO WO 98/34243 A1 8/1998
WO WO 99/28923 A1 6/1999

* cited by examiner

*Primary Examiner*—Anh Mai
(74) *Attorney, Agent, or Firm*—Venable LLP; Eric J. Franklin

(57) ABSTRACT

A device for absorbing axial and radial short-circuit forces in a cable-wound inductor. A fixing member includes an inner envelope surface that surrounds the cable winding of the inductor.

4 Claims, 2 Drawing Sheets

FIXING MEMBER

TECHNICAL FIELD

The present invention relates to a device for absorbing short-circuit forces in an inductor comprising at least one cable winding. In this context, cable winding means a winding constituted by a cable, in which the cable consists of an electric conductor that is surrounded by a solid, continuous insulating material.

BACKGROUND ART

Using inductors in electric power systems for transmission of electrical energy is known. Electric power systems in this connection mean systems for voltages exceeding 1 kilo-volt and inductors mean stationary induction machines such as reactors and transformers.

When an inductor is short-circuited, the cable winding of the inductor is subjected to axial and radial short-circuit forces. The radial forces in the inductor act outwards and bring about tensile stresses on the cable that constitutes the winding in the inductor. The axial forces in the inductor act upwards/downwards and bring about shearing stresses on the cable. When the inductor is short-circuited, both these types of mechanical stresses may lead to the cable being damaged. To avoid this, it is desirable, in cable-wound induction machines such as reactors and transformers, to protect the cable winding, for example by clamping the winding or minimizing the short-circuit forces.

WO 98/34243 describes a cable-wound transformer/reactor, where the winding is provided with a number of axially extending spacers, which separate each cable turn in a radial direction in the winding, in order, inter alia, to create axial cylindrical cooling ducts. Further, the spacer according to the embodiment is adapted to axially clamp the winding together into a uniform winding subassembly.

However, WO 98/34243 is limited to primarily absorbing short-circuit forces acting in the axial direction since no prestress in the radial direction occurs.

WO 99/28923 describes a cable-wound transformer with one high-voltage winding and one low-voltage winding. Here the turns of the high-voltage winding alternate with the turns of the low-voltage winding, in order thus to minimize the short-circuit forces. However, for reactors with one winding only, this method is not applicable.

SUMMARY OF THE INVENTION

The object of the present invention is to secure a cylinder-shaped cable winding in an inductor comprising cable. By means of the invention, this is achieved with the aid of a fixing member, whereby the above-mentioned disadvantages and problems are completely or partially overcome. It is another object to describe a method for mounting the fixing member on the cable winding.

The fixing member according to the invention is characterized in that it has the shape of a thin-walled cylinder with an inner and an outer envelope surface, the inner envelope surface surrounding the outside of the cable winding. Because the fixing member surrounds and clamps the cable winding, the cable is fixed in the winding and is thus prevented from being mechanically damaged by the short-circuit forces to which the cable is subjected during a short-circuit. The short-circuit forces acting in the radial and axial directions are absorbed by the friction between the cable and the fixing member and by the stiffness in the fixing member.

BRIEF DESCRIPTION OF THE DRAWINGS

The invention will be described in greater detail in the following with reference to the accompanying drawings, wherein.

DESCRIPTION OF THE PREFERRED EMBODIMENTS

Figure 1:
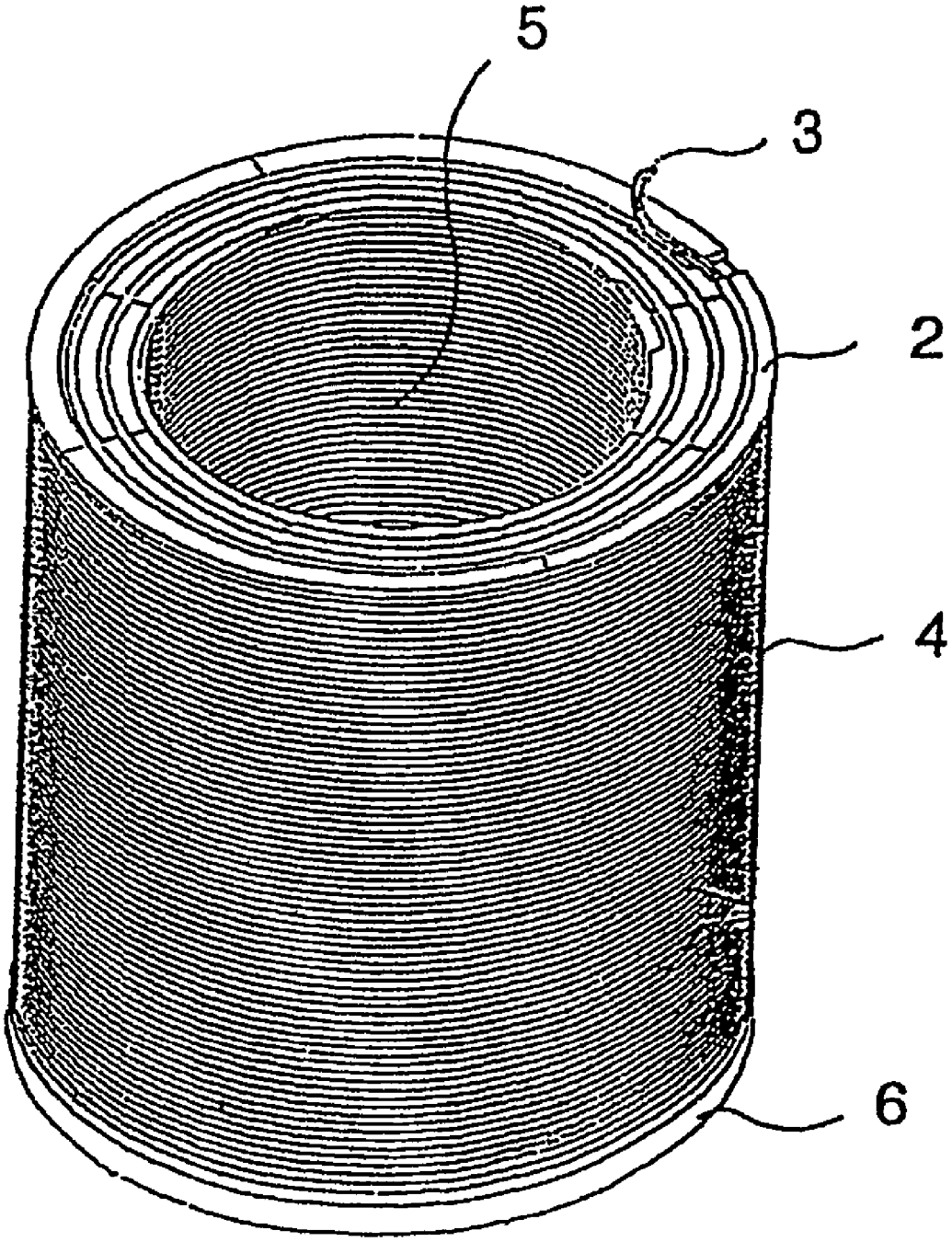
FIG. 1 shows parts of a cable-wound inductor in the form of a single-phase reactor with a lower winding plate.
Figure 2A:
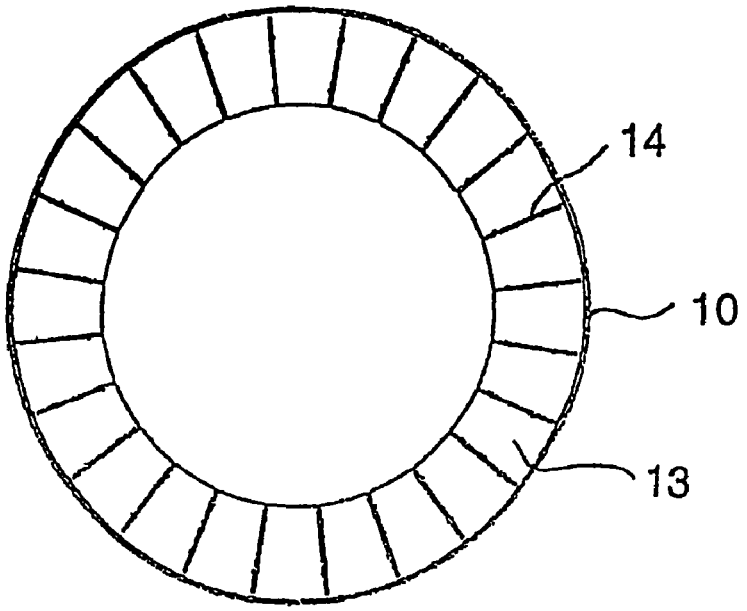
FIG. 2*a* shows a top view of a fixing member with an upper winding plate and brackets.
Figure 2B:
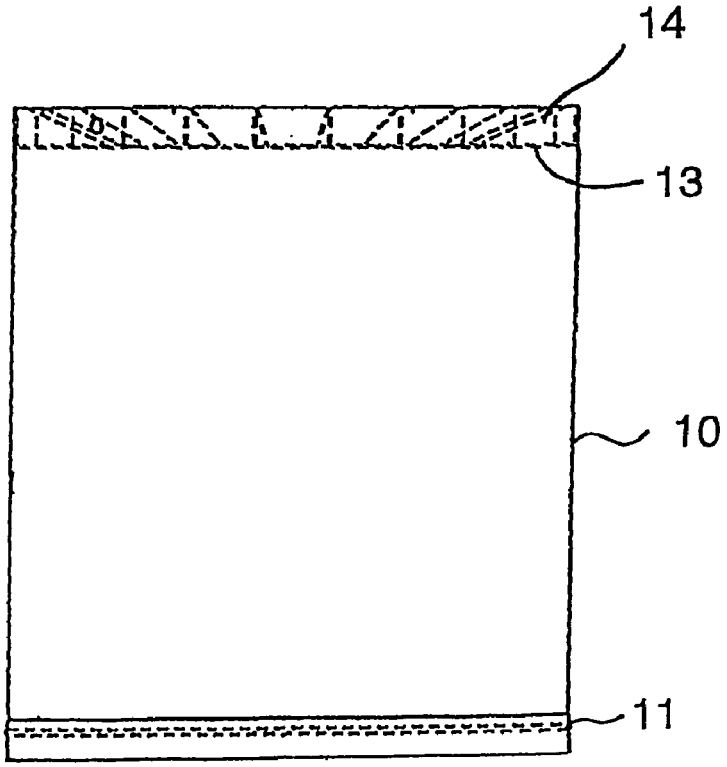
FIG. 2*b* shows a side view of a fixing member with an upper winding plate and brackets.

FIG. 1 shows parts of a cable-wound inductor in the form of a single-phase reactor. The reactor is intended for connection in series with a line in an electric power system (not shown) to limit the magnitude of fault currents. The reactor comprises a supporting structure 2 supporting a cable 3 that is wound so as to form a cylinder-shaped cable winding 4, which surrounds an air-filled centre portion 5 forming the air core of the reactor. The cable 3 is adapted to carry an electric current to generate a magnetic flux in the air core 5. The winding 4 is wound on top of a lower winding plate 6 of glass fibre-reinforced epoxy. On the lower winding plate there is a crescent-shaped slot (not shown) arranged around the envelope surface of the lower winding plate. In addition, four axially directed crescent-shaped slots (not shown) are arranged on the lower winding plate. FIG. 2 shows a fixing member 10 of glass fibre-reinforced epoxy, which is intended to be mounted around the winding 4. In the upper part of the fixing member 10, on the inner envelope surface thereof, an upper winding plate 13 of glass fibre-reinforces epoxy is arranged. On its upper side, 24 brackets 14 of glass fibre-reinforced epoxy are arranged. Corresponding brackets 14 are arranged in the same way on the underside of the lower winding plate 6 (not shown). Near the lower part of the fixing member 10, a crescent-shaped slot 11 is arranged around the envelope surface of the fixing member, and in the lower edge of the fixing member, four axially directed crescent-shaped slots are arranged (not shown).

Before the fixing member 10 is mounted across the winding 4, it is heated so that its diameter expands. When a sufficient diameter of the fixing member has been attained, the fixing member is fitted over the winding. The four crescent-shaped slots on the fixing member 10, together with the four crescent-shaped slots on the lower winding plate 6, form circular slots (not shown). In the four circular slots, four locking pins (not shown) are arranged, which prevent the fixing member from moving in the radial direction. Together with the crescent slots of the lower winding plate 6, the crescent slot 11 forms a circular slot that, together with a locking rod (not shown), prevents the fixing member from moving in the axial direction. When the fixing member has cooled from the heating, its diameter shrinks and tightens around the winding 4 that is now fixed and prestressed in the radial direction by the fixing member.

The strength in the fixing member 10 and the friction between the cable 3 and the fixing member 10 support the forces that arise during a short-circuit and hence prevent the cable 3 from being mechanically damaged by the stresses formed in the cable 3. In addition to the fixing member, also the lower winding plate 6 with brackets and the upper winding plate 13 with brackets 14 assist in absorbing short-circuit forces acting in the axial direction.

The principle of the invention has been described above on the basis of a cable-wound single-phase reactor with an air core. However, it is realized that the invention is also applicable to other types of cable-wound inductors, for example to cable-wound transformers with an iron core.

The invention claimed is:

1. An inductor for electric power system, comprising:

a cylindrical cable winding around an air core;

an absorbing device operative to absorb short-circuit forces in the coil, wherein the absorbing device comprises a thin-walled cylinder shaped fixing member comprising an inner surface and an outer surface, the inner surface surrounding the cylindrical cable winding and arranged to clamp an outer side of the cable winding; and a lower winding ring arranged at a lower end of the fixing member and an upper winding ring arranged at an upper end of the fixing member, the lower winding ring and the upper winding ring covering end parts of the cylindrical cable winding, wherein the fixing member, the lower winding ring and the upper winding ring are made of glass fiber-reinforced epoxy.

2. The device according to claim 1, wherein the clamping is carried out by prestress.

3. The device according to claim 1, wherein the lower winding ring and the upper winding ring comprise brackets arranged on sides that face away from the fixing member.

4. A method for mounting a device, the method comprising:

providing a cylindrical cable winding around an air core;

providing an absorbing device operative to absorb short-circuit forces in the coil, wherein the absorbing device comprises a thin-walled cylinder shaped fixing member comprising an inner surface, an outer surface, a lower winding ring arranged at a lower end of the fixing member, and an upper winding ring arranged at an upper end of the fixing member, wherein the fixing member, the lower winding ring and the upper winding ring are made of glass fiber-reinforced epoxy;

heating the fixing member such that a diameter of the fixing member increases; and fitting the fixing member over the cable winding, such that the inner surface surrounds the cable winding and is arranged to clamp an outer side of the cable winding and the lower winding ring and the upper winding ring cover end parts of the cable winding.

* * * * *